US007352351B2

(12) United States Patent
Jang et al.

(10) Patent No.: US 7,352,351 B2
(45) Date of Patent: Apr. 1, 2008

(54) ACTIVE MATRIX-TYPE DISPLAY DEVICE AND METHOD OF DRIVING THE SAME

(75) Inventors: Yong-Ho Jang, Gyeonggi-do (KR); Kyung-Eon Lee, Gyeonggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 792 days.

(21) Appl. No.: 10/789,987

(22) Filed: Mar. 2, 2004

(65) Prior Publication Data

US 2004/0196242 A1 Oct. 7, 2004

(30) Foreign Application Priority Data

Mar. 6, 2003 (KR) ..... 10-2003-0013949

(51) Int. Cl.
*G09G 3/36* (2006.01)
*G09G 5/00* (2006.01)

(52) U.S. Cl. ..... 345/99; 345/213

(58) Field of Classification Search ..... 345/87–104
See application file for complete search history.

(56) References Cited

U.S. PATENT DOCUMENTS 5,731,798 A * 3/1998 Shin ..... 345/99
6,320,575 B1 * 11/2001 Terashima et al. ..... 345/213
6,329,975 B1 * 12/2001 Yamaguchi ..... 345/99
6,538,633 B1 * 3/2003 Ito ..... 345/99
6,600,469 B1 * 7/2003 Nukiyama et al. ..... 345/87
6,778,170 B1 * 8/2004 Shu et al. ..... 345/213
6,791,518 B2 * 9/2004 Furukoshi ..... 345/87
7,145,544 B2 * 12/2006 Oohira ..... 345/99

* cited by examiner

*Primary Examiner*—Richard Hjerpe
*Assistant Examiner*—M. Fatahiyar
(74) *Attorney, Agent, or Firm*—Morgan, Lewis & Bockius LLP

(57) ABSTRACT

A liquid crystal display device includes a liquid crystal panel having a pixel region, a graphic interface unit generating a first data enable signal having first and second time intervals, a signal modulating unit generating a second data enable signal by using the first data enable signal, the second data enable signal having third and fourth time intervals, and a timing controller generating the data signals by using the second data enable signal, wherein data signals are not input to the pixel region during the third time interval and are input to the pixel region during the fourth time interval, and the forth time interval is shorter than the second time interval.

18 Claims, 11 Drawing Sheets

3/4
frame time

4/4
frame time

ACTIVE MATRIX-TYPE DISPLAY DEVICE AND METHOD OF DRIVING THE SAME

The present invention claims the benefit of Korean Patent Application No. 2003-13949 filed in Korea on Mar. 6, 2003, which is hereby incorporated by reference.

BACKGROUND OF THE INVENTION

1. Field of the Invention

The present invention relates to a flat panel display device, and more particularly, to an active matrix-type liquid crystal display device and a method of driving the same.

2. Discussion of the Related Art

Cathode ray tube (CRT) devices have been commonly used for display devices, such as a television and a monitor. However, the CRT devices have some disadvantages, such as heavy weight, large volume, and high driving voltages. Accordingly, flat panel display (FPD) devices, such as liquid crystal display (LCD) devices and organic electroluminescent display (ELD) devices, are being developed, and have excellent operational characteristics, such as light weight and low power consumption. These devices are commonly used in notebook computers, office automation apparatus, and audio/video apparatus.

In general, an LCD device is a non-emissive display device that displays images by making use of a refractive index difference utilizing optical anisotropy properties of a liquid crystal material interposed between an array substrate and a color filter substrate. On the other hand, an ELD device is an emissive display device making use an electroluminescent (EL) phenomenon, wherein light is emitted from a luminescent layer when an electric field is applied.

Recently, active matrix-type display devices in which a plurality of pixel regions are disposed in matrix and a switching element, such as a thin film transistor (TFT), is formed at each pixel region, are commonly being used because of their superior display of moving images.

FIG. 1 is a schematic block diagram of a liquid crystal display device according to the related art. In FIG. 1, RGB data and timing sync signals, such as clock signals, horizontal sync signals, vertical sync signals, and data enable signals, are input from a driving system (not shown), such as a personal computer, to an interface 10. The interface 10 outputs the RGB data and the timing sync signals to a timing controller 12. For example, a low voltage differential signal (LVDS) interface and TTL interface may be used for transmission of the RGB data and the timing sync signals. In addition, the interface 10 may be integrated in a single chip together with the timing controller 12. The timing controller 12 generates data control signals for a data driver 18, including a plurality of data integrated circuits (ICs), and gate control signals for a gate driver 20, including a plurality of gate ICs. Moreover, the timing controller outputs data signals to the data driver 18.

Reference voltage generator 16 generates reference voltages of a digital-to-analog converter (DAC) used in the data driver 18. The reference voltages are set up according to transmittance-voltage characteristics of a liquid crystal panel 2. The data driver 18 determines reference voltages for the data signals according to the data control signals and outputs the determined reference voltages to the liquid crystal panel 2 to adjust a rotation angle of liquid crystal molecules. The gate driver 20 controls ON/OFF operation of thin film transistors (TFTs) in the liquid crystal panel 2 according to the gate control signals from the timing controller 12. Accordingly, the data signals from the data driver 18 are supplied to pixels of the liquid crystal panel 2 through the TFTs. Source voltage generator 14 supplies source voltages to elements of the LCD device and a common voltage to the liquid crystal panel 2.

FIG. 2 is a schematic block diagram of a timing controller for a liquid crystal display device according to the related art. In FIG. 2, a timing controller 12 includes a control signal generator 36, a data signal generator 32, and a signal discriminating portion 28. The control signal generator 36 generates data control signals and gate control signals by using timing sync signals, such as a horizontal sync signal "Hsync," a vertical sync signal "Vsync," a data enable signal "DE," and a clock from an interface 10 (in FIG. 1), and supplies the data control signals and the gate control signals to a data driver 18 (in FIG. 1) and a gate driver 20 (in FIG. 1). The data signal generator 32 generates data signals by using RGB data from the interface 10 (in FIG. 1) and supplies the data signals to the data driver 18 (in FIG. 1). The signal discriminating portion 28 determines whether all of the RGB data and the timing sync signals are supplied from the interface 10 (in FIG. 1). In addition, an oscillator 26 supplies reference signals of a specific frequency to the signal discriminating portion 28.

FIG. 3 is a schematic timing diagram of timing sync signals for a timing controller according to the related art. In FIG. 3, a vertical sync signal "Vsync" corresponds to a time interval for one frame and a horizontal sync signal "Hsync" corresponds to a time interval for one gate line. Accordingly, the horizontal sync signal "Hsync" includes peaks corresponding to the number of gate lines in a liquid crystal panel 2 (in FIG. 1). A data enable signal "DE" corresponds to a time interval for supplying data signals to pixels of the liquid crystal panel 2 (in FIG. 1). The data enable signal "DE" includes a first time interval and a second time interval. Accordingly, the data signals are supplied to the pixel during the second time interval, while no data signals are supplied to pixels during the first time interval. In the second time interval, the data enable signal "DE" includes a plurality of peaks "P."

A control signal generator 36 (in FIG. 2) supplies data control signals and gate control signals to data driver 18 (in FIG. 1) and gate driver 20 (in FIG. 1), respectively, according to the vertical sync signal "Vsync" and the horizontal sync signal "Hsync" from an interface 10 (in FIG. 1). In addition, a data signal generator 32 (in FIG. 2) supplies the data signals to the pixels through the data driver 18 (in FIG. 1) according to the data enable signal "DE" from the interface 10 (in FIG. 1).

FIG. 4 is a schematic timing diagram of output signals of a timing controller according to the related art. In FIG. 4, output signals of a timing controller 12 (in FIG. 1) include a gate output enable signal "GOE," a gate shift clock "GSC," a source output enable signal "SOE," a gate start pulse "GSP," and a polarity reverse signal "POL." Although not shown in FIG. 4, a source sampling clock "SSC" and a source start pulse "SSP" may be output from the timing controller 12 (in FIG. 1).

Data signals are latched according to a rising edge or a falling edge of the source sampling clock "SSC," and the source output enable signal "SOE" controls a transmission of the data signals latched by the source sampling clock "SSC" to a liquid crystal panel 2 (in FIG. 1). The source start pulse "SSP" assigns a starting point of one horizontal line (gate line), i.e., a first pixel that the data signals are inputted. The gate shift clock "GSC" assigns a time interval for ON state of a thin film transistor (TFT) and the gate output enable signal "GOE" controls an output of a gate driver 20

(in FIG. 1). The gate start pulse "GSP" assigns a starting line of one frame, i.e., a first line that gate signals are input. The polarity reverse signal "POL" adds one of positive polarity (+) and negative polarity (−) to the data signals during an inversion driving method, such as a dot inversion method. A data signal generator 32 (in FIG. 2) re-arranges RGB data transmitted from an interface 10 (in FIG. 1) and supplies the re-arranged RGB data, i.e., the data signals to the liquid crystal panel 2 (in FIG. 1), through a data driver 18 (in FIG. 1).

FIGS. 5A to 5E are schematic transitional images between frames in a liquid crystal display device according to the related art. FIG. 5A shows a first image of a first frame, FIG. 5E shows second image of a second frame following the first frame. In addition, FIGS. 5B, 5C, and 5D show a mixed image at one, two, and three quarters of one frame time, respectively.

In FIGS. 5A to 5E, most of the second frame time is used for rendering the second image. For example, the second image may be rendered during a time interval more than about 90% of the second frame time. During a refresh driving method of an XGA (1024×768) at 75 Hz, one frame time is about 16 ms and a total number of scan lines (gate lines) is about 800 for one frame. Among the scan lines, about 768 lines are substantially used for displaying images, and are commonly referred to as active lines. Thus, an active time interval for writing images to the active lines is about 15.35 ms (i.e., 16 ms×(768/800)), and this value corresponds to about 96% of one frame time. Accordingly, most of one frame time is used for rendering an image. As shown in FIG. 3, the percentage of the second time interval of the data enable signal "DE" (in FIG. 3) to the sum of the first and second time periods may be more than about 96%.

In FIGS. 5A to 5E, an image is changed from rectangular shape to triangular shape. After completing the first image of rectangular shape, data signals for the second image of triangular shape are written in a liquid crystal panel on a line-by-line basis with the passage of time. The arrows in FIGS. 5B to 5E designate a scan line I which the data signals are written at the corresponding time. In other words, the mixed image of the first and second images is displayed during most of one frame time.

The above-described driving method is suitable for the CRT devices, in which an electron beam instantly collides with fluorescent material of a screen. However, in active matrix-type LCD devices, the data signals may be stored in each pixel during one frame time and the stored data signals may continue driving liquid crystal molecules until the next data signals are written. When the LCD devices are driven using the above-described driving method, wherein most of one frame time is used for rendering an image, excessive time is used for rendering the image. Accordingly, an undesirable mixed image is excessively displayed.

SUMMARY OF THE INVENTION

Accordingly, the present invention is directed to an active matrix-type display device and a method of driving an active matrix-type display device that substantially obviates one or more of problems due to limitations and disadvantages of the related art.

An object of the present invention is to provide an active matrix-type display device having high time resolution.

Another object of the present invention is to provide a method of driving an active matrix-type display device having high time resolution.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a liquid crystal panel having a pixel region, a graphic interface unit generating a first data enable signal having first and second time intervals, a signal modulating unit generating a second data enable signal by using the first data enable signal, the second data enable signal having third and fourth time intervals, and a timing controller generating the data signals by using the second data enable signal, wherein data signals are not input to the pixel region during the third time interval and are input to the pixel region during the fourth time interval, and the forth time interval is shorter than the second time interval.

In another aspect, a liquid crystal display device includes a liquid crystal panel having a pixel region, a graphic interface unit generating a data enable signal having first and second time intervals, and a timing controller generating the data signals by using the data enable signal, wherein data signals are not input to the pixel region during the first time interval and are input to the pixel region during the second time interval, the first and second time intervals constitute single frame time, and the second time interval is less than about 80% of the single frame time.

In another aspect, a method of driving a liquid crystal display device having a liquid crystal panel, a graphic interface unit, a signal modulating unit, and a timing controller includes generating a first data enable signal having first and second time intervals in the graphic interface unit, generating a second data enable signal by using the first data enable signal in the signal modulating unit, the second data enable signal having third and fourth time intervals, and generating the data signals by using the second data enable signal in the timing controller, wherein data signals are not input to the liquid crystal panel during the third time interval and are input to the liquid crystal panel during the fourth time interval, and the forth time interval is shorter than the second time interval.

In another aspect, a method of driving a liquid crystal display device having a liquid crystal panel, a graphic interface unit, and a timing controller, includes generating a data enable signal having first and second time intervals in the graphic interface unit, and generating the data signals by using the data enable signal the timing controller, wherein data signals are not input to the liquid crystal panel during the first time interval and are input to the liquid crystal panel during the second time interval, the first and second time intervals constitute single frame time, and the second time interval is less than about 80% of the single frame time.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
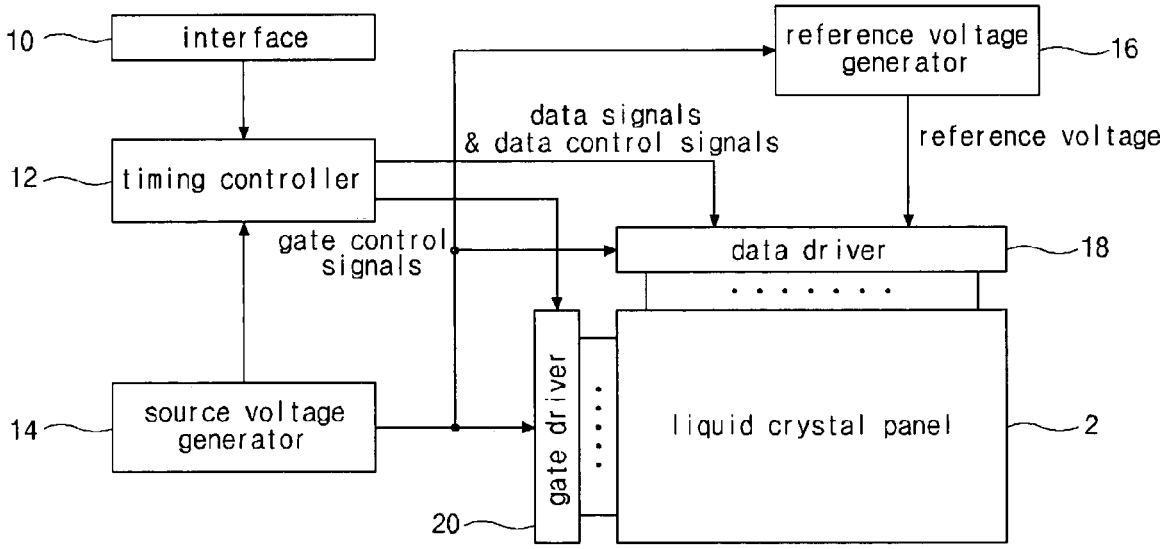
FIG. 1 RELATED ART
FIG. 1 is a schematic block diagram of a liquid crystal display device according to the related art.
Figure 2:
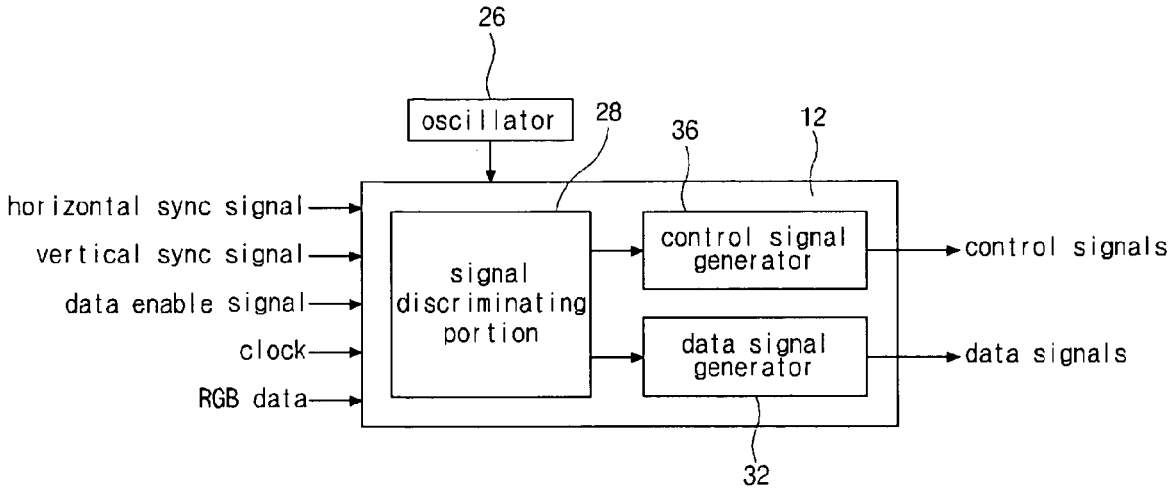
FIG. 2 RELATED ART
FIG. 2 is a schematic block diagram of a timing controller for a liquid crystal display device according to the related art.
Figure 3:
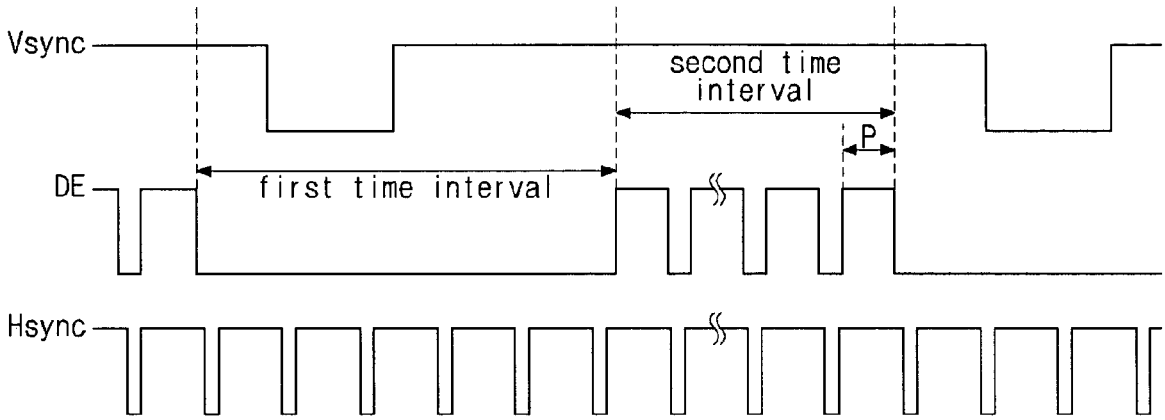
FIG. 3 RELATED ART
FIG. 3 is a schematic timing diagram of timing sync signals for a timing controller according to the related art.
Figure 4:
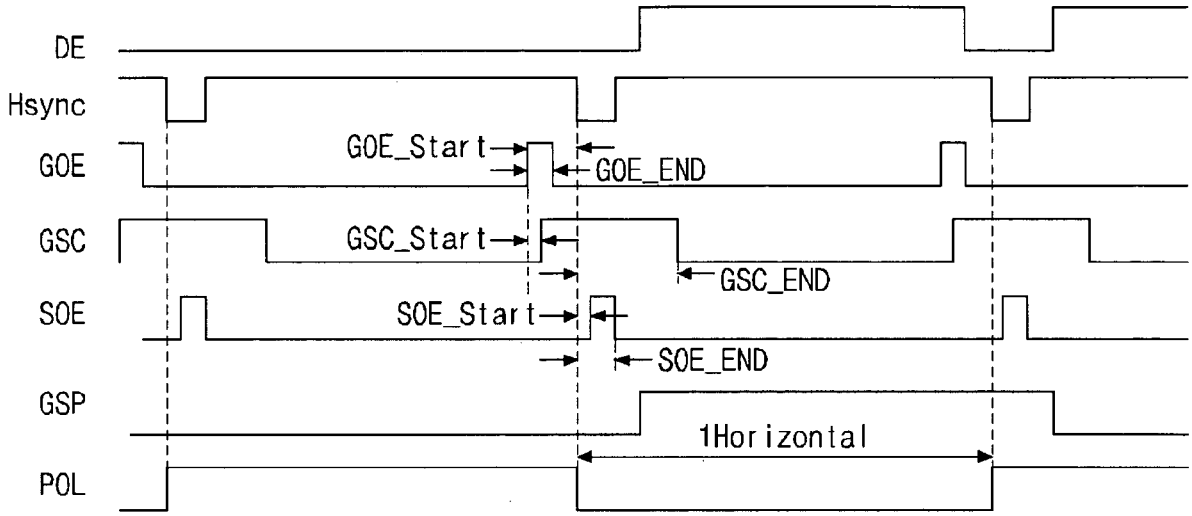
FIG. 4 RELATED ART
FIG. 4 is a schematic timing diagram of output signals of a timing controller according to the related art.
Figure 5A:
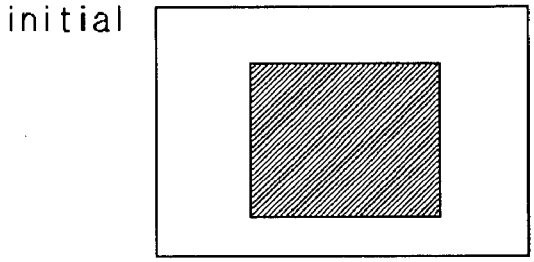
FIG. 5A RELATED ART
FIGS. 5A to 5E are schematic transitional images between frames in a liquid crystal display device according to the related art.
Figure 5B:
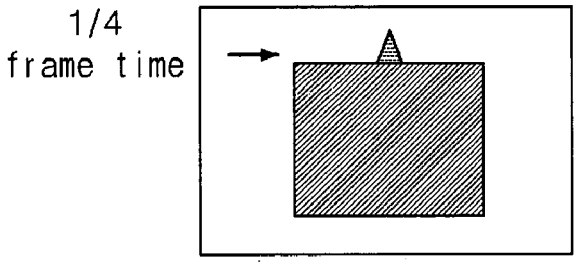
FIG. 5B RELATED ART
Figure 5C:
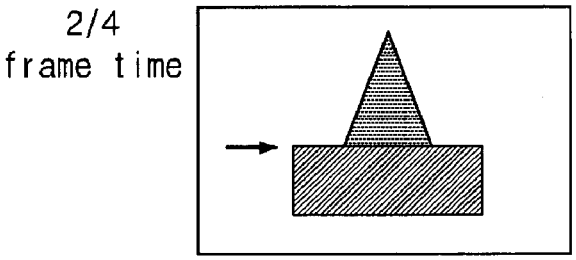
FIG. 5C RELATED ART
Figure 5D:
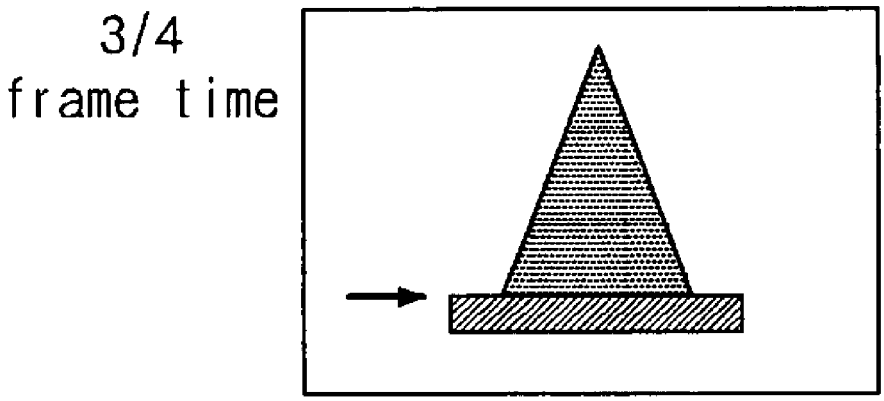
FIG. 5D RELATED ART
Figure 5E:
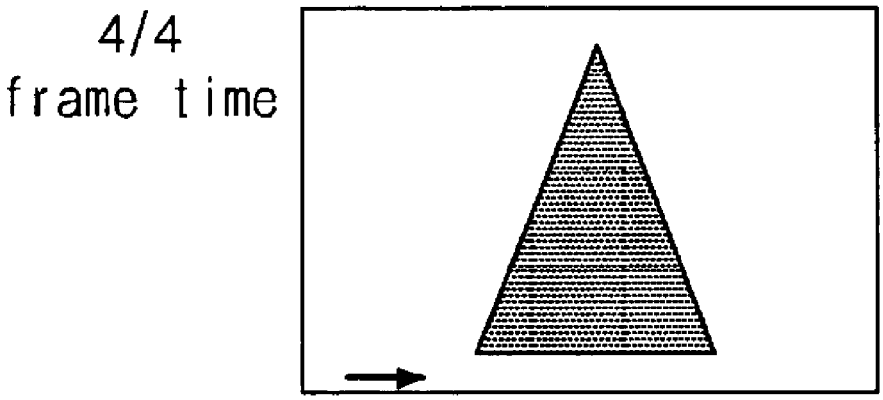
FIG. 5E RELATED ART
Figure 6:
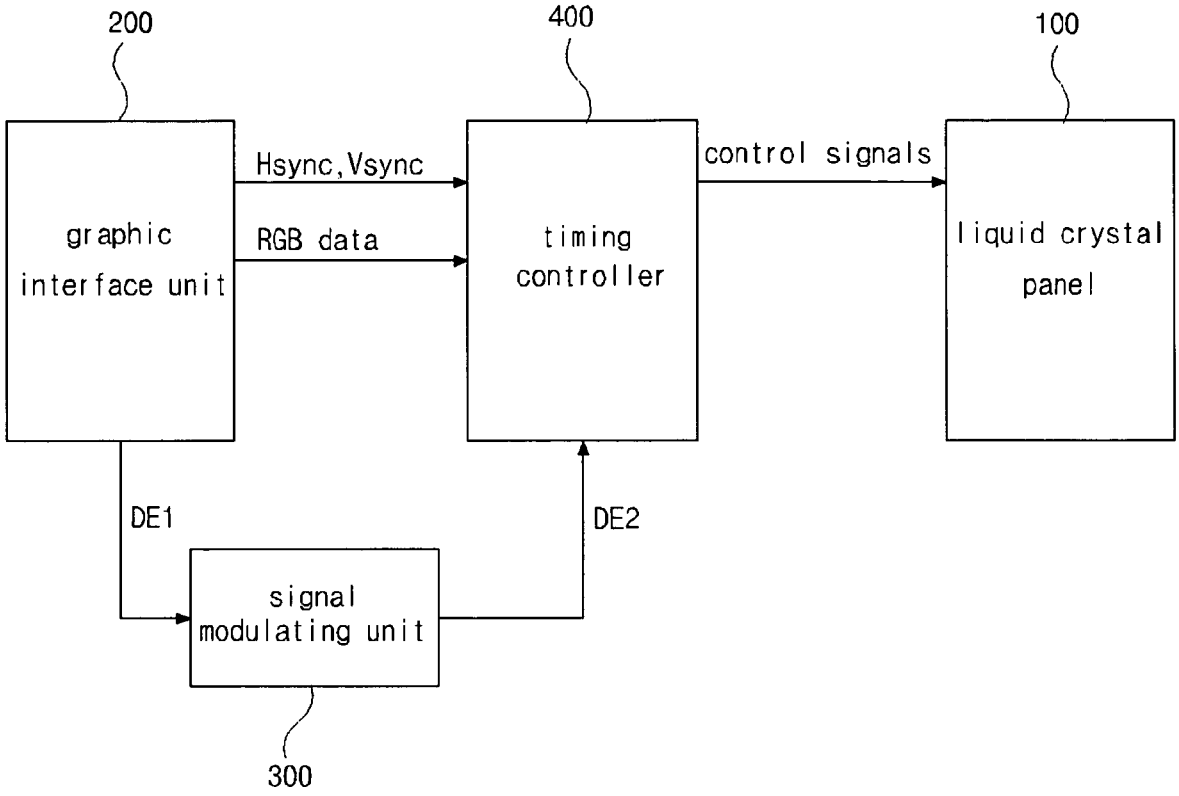
FIG. 6 is a schematic block diagram of an exemplary active matrix-type liquid crystal display device according to the present invention.
Figure 7:
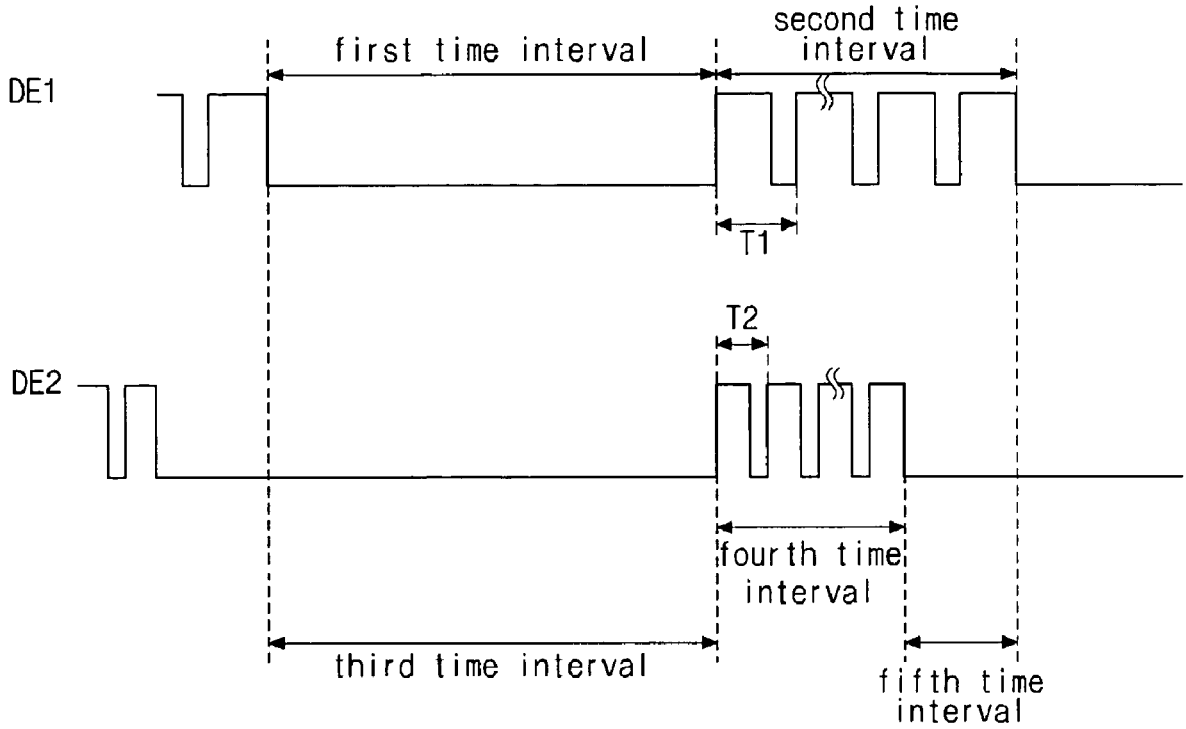
FIG. 7 is a schematic timing diagram of exemplary first and second data enable signals for an active matrix-type liquid crystal display device according to the present invention.

FIG. 6 is a schematic block diagram of an exemplary active matrix-type liquid crystal display device according to the present invention, and FIG. 7 is a schematic timing diagram of exemplary first and second data enable signals for an active matrix-type liquid crystal display device according to the present invention.

In FIGS. 6 and 7, a liquid crystal panel 100 may include a gate line (not shown) and a data line (not shown) in a matrix configuration, wherein the gate line and the data line may cross each other to define a pixel region (not shown), and a thin film transistor (TFT) is connected to the gate line and the data line in each pixel region. In addition, control signals and data signals may be transmitted to a gate driver (not shown) and a data driver (not shown), wherein the data signals may be supplied to a liquid crystal layer (not shown) through the TFT to drive the liquid crystal molecules of the liquid crystal layer.

In FIG. 6, a graphic interface unit 200 may generate a horizontal sync signal "Hsync," a vertical sync signal "Vsync," red-green-blue (RGB) data, a first data enable signal "DE1," and a clock signal. The first data enable signal "DE1" may include a first time interval and a second time interval. If the first data enable signal "DE1" is directly supplied to a timing controller 400, the data signals may not be supplied to the liquid crystal layer during the first time interval, but may be supplied to the liquid crystal layer during the second time interval. Moreover, the first data enable signal "DE1" may include a plurality of peaks having a first frequency (not shown) and a first period "T1" in the second time interval.

A signal modulating unit 300 may generate a second data enable signal "DE2," which may include third, fourth, and fifth time intervals, by using the first data enable signal "DE1." Similarly to the first data enable signal "DE1," the data signals may not be supplied to the liquid crystal layer during the third and fifth time intervals, but may be supplied to the liquid crystal layer during the fourth time interval. Moreover, the second data enable signal "DE1" may include a plurality of peaks having a second frequency and a second period "T2" in the fourth time interval. Accordingly, the second frequency may be higher than the first frequency, and the second period "T2" may be shorter than the first period "T1." Thus, the fourth time interval may be shorter than the second time interval.

For example, the signal modulating unit 300 may generate and supply the second data enable signal "DE2" by modulating the first frequency and the first period "T1" of the first data enable signal "DE1" into the second frequency and the second period "T2." Accordingly, the second data enable signal "DE2," instead of the first data enable signal "DE1," may be supplied to the timing controller 400. If the first data enable signal "DE1" is directly used for the timing controller 400, a first image of a first frame may be displayed through the liquid crystal panel 100 during the first time interval and a mixed image of first and second frames may be displayed through the liquid crystal panel 100 during the second time interval. However, according to the present invention, the second data enable signal "DE2" may be supplied to the timing controller 400. Accordingly, a first image of a first frame may be displayed during the third time interval, a mixed image of first and second frames may be displayed during the fourth time interval, and a second image of a second frame may be displayed during the fifth time interval. Thus, a time interval for displaying a mixed image of two frames may be reduced, while a time interval for displaying an image of one frame may increase. As shown in FIG. 7, the fourth time interval may be shorter than the second time interval, and a sum of the third and fifth time intervals may be longer than the first interval.

The timing controller 400 may generate control signals for driving the liquid crystal panel 100 by using output signals of the graphic interface units 200 and the second data enable signal "DE2" output from the signal modulating unit 300. Although the signal modulating unit 300 may be independently provided, as shown in FIG. 6, the signal modulating unit 300 may be disposed with the graphic interface unit 200 or with the timing controller 400 for effective design and fabrication.

Figure 8A:
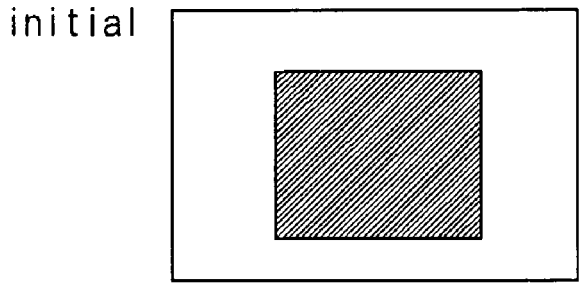
FIGS. 8A to 8E are schematic views of exemplary transitional images between frames in a liquid crystal display device according to the present invention.
Figure 8B:
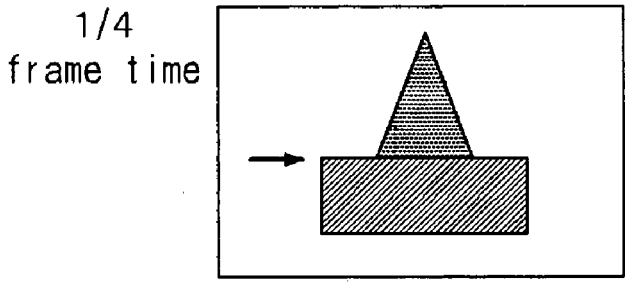
Figure 8C:
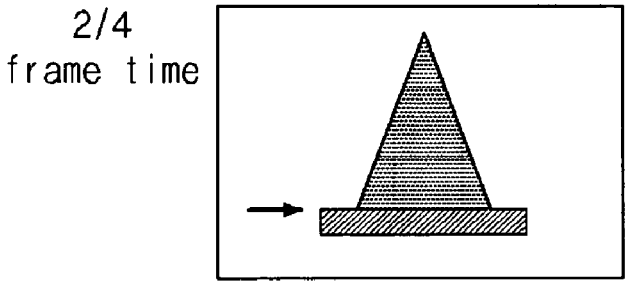
Figure 8D:
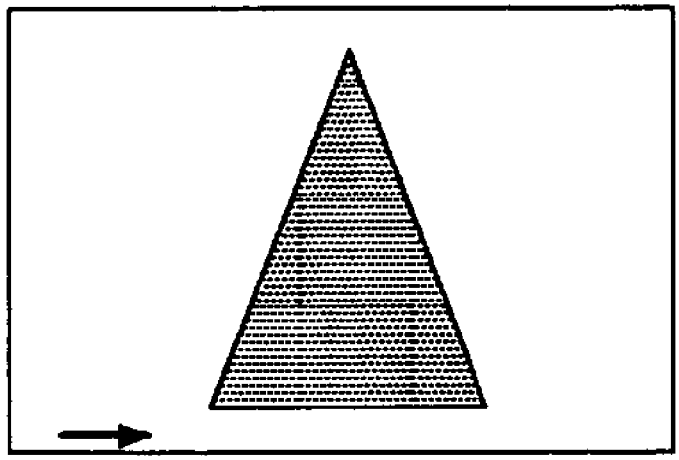
Figure 8E:
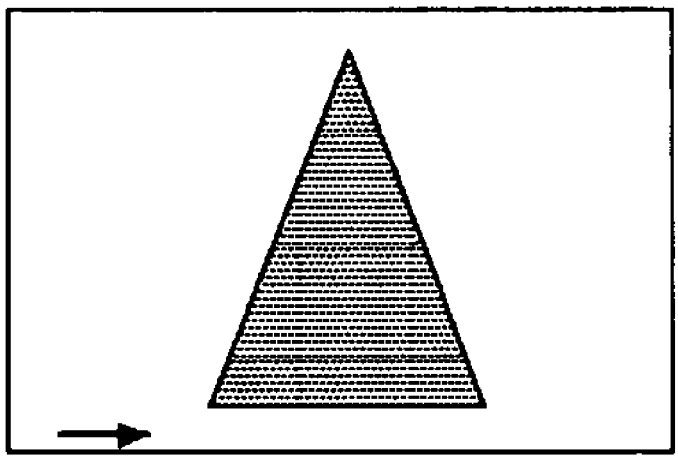

FIGS. 8A to 8E are schematic views of exemplary transitional images between frames in a liquid crystal display device according to the present invention. FIG. 8A shows a first image of a first frame, and FIG. 8B shows a mixed image of first and second frames at a first quarter of one frame time, and FIG. 8C shows a mixed image of first and second frames at a second quarter of one frame time. In addition, FIGS. 8D and 8E show a second image of a second frame following the first frame.

In FIGS. 8A to 8E, for example, a first image of a first frame may have a rectangular shape and a second image of a second frame may have a triangular shape. Since a mixed image of the first and second frames may be displayed only at the first and second quarters of one frame time, a time for transition from the first image to the second image may be reduced. While one frame time is kept identical, data signals may be supplied to a liquid crystal layer during a shorter time period, wherein scan lines (gate lines) may be driven faster. Accordingly, the transition time may be reduced and a residual time is assigned for an image of the next frame. Since a time interval for displaying a mixed image of two frames may be reduced, elements in a driving circuit may rest for a longer time interval and stability of the elements may be improved.

For example, while a second image may be rendered during a time interval more than about 90% of a second frame time in a liquid crystal display device according to the related art, a second image may be rendered during a time interval of about 20% to about 80% of a second frame time in a liquid crystal display device according to the present invention. In other words, a mixed image of two frames may be displayed during a time interval of about 20% to about 80% of one frame time, and an image of single frame may be displayed during a residual time interval. Since the data signals may not be input to the liquid crystal panel during the residual time interval, the elements of the driving circuit may rest to improve stability.

In FIG. 6, the second data enable signal "DE2" may be generated in the signal modulating unit 300 by using the first data enable signal "DE1." Alternatively, a data enable signal may be generated in a graphic interface unit such that the second time interval may be less than about 80% of one frame time having first and second time interval and a signal modulating unit may be omitted.

Figure 9:
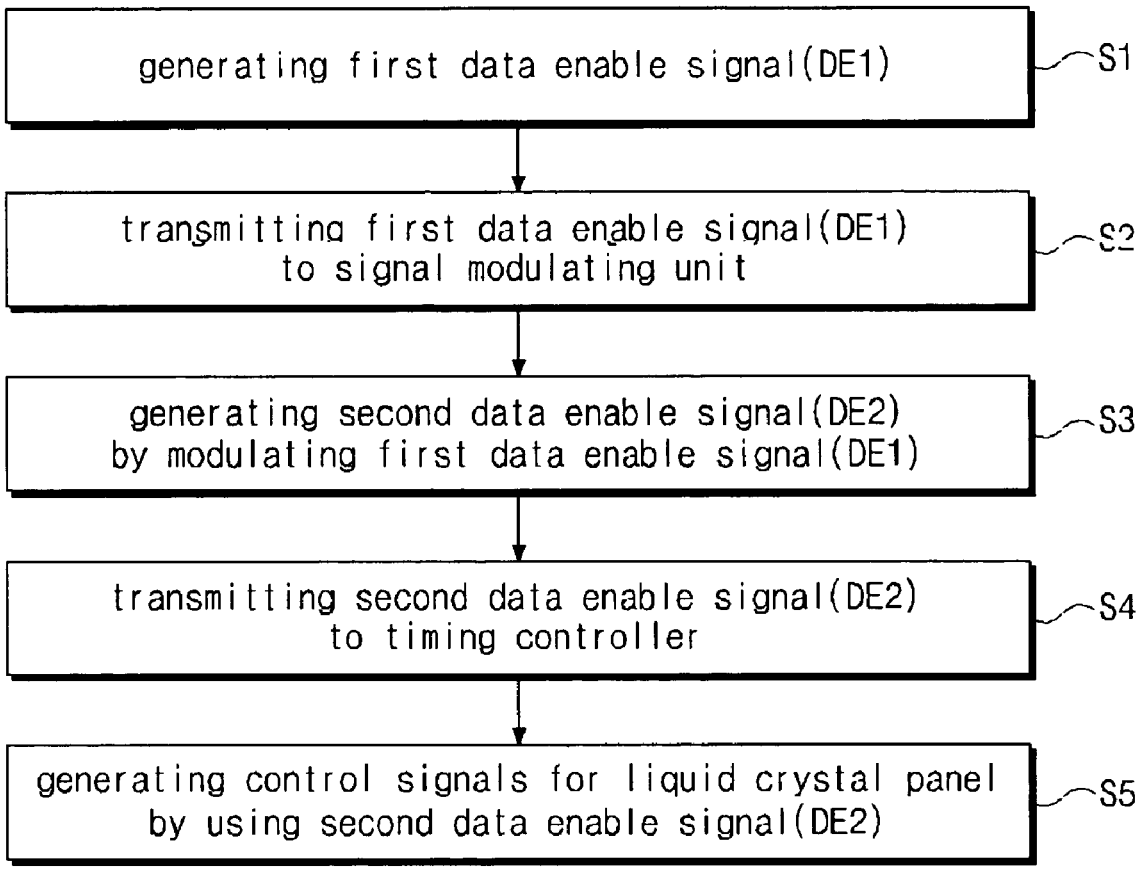
FIG. 9 is a schematic diagram of an exemplary method of driving a liquid crystal display device according to the present invention.

FIG. 9 is a schematic diagram of an exemplary method of driving a liquid crystal display device according to the present invention. In FIG. 9, a step S1 may include, as shown in FIG. 6, a graphic interface unit 200 for generating a horizontal sync signal "Hsync," a vertical sync signal "Vsync," RGB data, and a first data enable signal "DE1." In addition, the first data enable signal "DE1" may include a plurality of peaks having a first period "T1" (in FIG. 7).

At step S2, as shown in FIG. 6, the first data enable signal "DE1" of the graphic interface unit 200 may be transmitted to a signal modulating unit 300, while the horizontal sync signal "Hsync," the vertical sync signal "Vsync," and the RGB data may be transmitted to a timing controller 400.

At step S3, a second data enable signal "DE2" may be generated in the signal modulating unit 300 (in FIG. 6) by modulating the first period "T1" (in FIG. 7) of the first data enable signal "DE1." The second data enable signal "DE2" may include a plurality of peaks having a second period "T2" (in FIG. 7) that may be shorter than the first period "T1" (in FIG. 7).

At step S4, as shown in FIG. 6, the second data enable signal "DE2" of the signal modulating unit 300 may be transmitted to the timing controller 400. Accordingly, the horizontal sync signal "Hsync," the vertical sync signal "Vsync," the RGB data, and the second data enable signal "DE2" may be input to the timing controller 400.

At step S5, as shown in FIG. 6, the timing controller 400 may generate control signals for driving a liquid crystal panel 100 by using the input signals, including the second data enable signal "DE2."

According to the present invention, an active time interval wherein data signals are substantially input to a pixel of the liquid crystal display device may be reduced, and a non-active time interval wherein the data signals are stored in a storage capacitor and/or a liquid crystal capacitor is displayed may increase. Accordingly, image resolution, with respect to time, may be improved and inferiority of display quality may be prevented by reducing a time interval for a mixed image of two frames.

Although a liquid crystal display device is adopted according to the present invention, the present invention may be applied to other types of active matrix-type display devices, such as an electroluminescent display device and a plasma display panel.

It will be apparent to those skilled in the art that various modifications and variations can be made in the active matrix-type display device and method of driving the same of the present invention without departing from the spirit or scope of the inventions. Thus, it is intended that the present invention covers the modifications and variations of this invention provided they come within the scope of the appended claims and their equivalents.

What is claimed is:

1. A liquid crystal display device, comprising:

a liquid crystal panel having a pixel region;

a graphic interface unit generating a first data enable signal having first and second time intervals;

a signal modulating unit generating a second data enable signal by using the first data enable signal, the second data enable signal having third and fourth time intervals; and a timing controller generating data signals by using the second data enable signal, wherein the data signals are not input to the pixel region during the third time interval and are input to the pixel region during the fourth time interval, and the forth time interval is shorter than the second time interval.

2. The device according to claim 1, wherein the third and fourth time intervals constitute single frame time, and the fourth time interval is less than about 80% of the single frame time.

3. The device according to claim 1, wherein the first data enable signal includes a plurality of first peaks having a first period and the second data enable signal includes a plurality of second peaks having a second period.

4. The device according to claim 3, wherein the second period is shorter than the first period.

5. The device according to claim 4, wherein the signal modulating unit modulates from the first period to the second period.

6. The device according to claim 1, wherein the graphic interface unit further generates a horizontal sync signal, a vertical sync signal, and RGB data.

7. The device according to claim 1, wherein the liquid crystal panel includes a gate line, a data line, a thin film transistor connected to the gate line and the data line, and a liquid crystal layer in the pixel region, and the gate line and the data line cross each other to define the pixel region.

8. The device according to claim 1, wherein the signal modulating unit is disposed in one of the graphic interface unit and the timing controller.

9. A liquid crystal display device, comprising:

a liquid crystal panel having a pixel region;

a graphic interface unit generating a data enable signal;

a signal modulating unit generating a modulated data enable signal by using the data enable signal, the modulated data enable signal having first and second time intervals; and a timing controller generating data signals by using the data enable signal, wherein the data signals are not input to the pixel region during the first time interval and are input to the pixel region during the second time interval, the first and second time intervals constitute single frame time, and the second time interval is less than about 80% of the single frame time.

10. The device according to claim 9, wherein the graphic interface unit further generates a horizontal sync signal, a vertical sync signal, and RGB data.

11. The device according to claim 9, wherein the liquid crystal panel includes a gate line, a data line, a thin film transistor connected to the gate line and the data line, and a liquid crystal layer in the pixel region, and the gate line and the data line cross each other to define the pixel region.

12. A method of driving a liquid crystal display device having a liquid crystal panel, a graphic interface unit, a signal modulating unit, and a timing controller, comprising:

generating a first data enable signal having first and second time intervals in the graphic interface unit;

generating a second data enable signal by using the first data enable signal in the signal modulating unit, the second data enable signal having third and fourth time intervals; and generating data signals by using the second data enable signal in the timing controller, wherein the data signals are not input to the liquid crystal panel during the third time interval and are input to the liquid crystal panel during the fourth time interval, and the forth time interval is shorter than the second time interval.

13. The method according to claim 12, wherein the third and fourth time intervals constitute single frame time, and the fourth time interval is less than about 80% of the single frame time.

14. The method according to claim 12, wherein the first data enable signal includes a plurality of first peaks having a first period, and the second data enable signal includes a plurality of second peaks having a second period.

15. The method according to claim 14, wherein the signal modulating unit modulates the first data enable signal to the second data enable signal such that the second period is shorter than the first period.

16. The method according to claim 12, further comprising generating a horizontal sync signal, a vertical sync signal, and RGB data in the graphic interface unit.

17. A method of driving a liquid crystal display device having a liquid crystal panel, a graphic interface unit, a signal modulating unit and a timing controller, comprising:

generating a data enable signal in the graphic interface unit;

generating a modulated data enable signal by using the data enable signal in the signal modulating unit, the modulated data enable signal having first and second time intervals; and generating data signals by using the data enable signal in the timing controller, wherein the data signals are not input to the liquid crystal panel during the first time interval and are input to the liquid crystal panel during the second time interval, the first and second time intervals constitute single frame time, and the second time interval is less than about 80% of the single frame time.

18. The method according to claim 17, further comprising generating a horizontal sync signal, a vertical sync signal, and RGB data in the graphic interface unit.

* * * * *